US012030687B2

(12) United States Patent
Königshofer et al.

(10) Patent No.: US 12,030,687 B2
(45) Date of Patent: Jul. 9, 2024

(54) AUTOMATED REMOVAL OF BINDING TAPES FROM A COIL

(71) Applicant: Primetals Technologies Germany GmbH, Erlangen (DE)

(72) Inventors: Martin Königshofer, Strengberg (AT); Ralf Smukalski, Weilersbach (DE)

(73) Assignee: Primetals Technologies Germany GmbH, Erlangen (DE)

( * ) Notice: Subject to any disclaimer, the term of this patent is extended or adjusted under 35 U.S.C. 154(b) by 120 days.

(21) Appl. No.: 17/760,619

(22) PCT Filed: Sep. 9, 2020

(86) PCT No.: PCT/EP2020/075195
§ 371 (c)(1),
(2) Date: Mar. 15, 2022

(87) PCT Pub. No.: WO2021/052834
PCT Pub. Date: Mar. 25, 2021

(65) Prior Publication Data

US 2022/0332456 A1 Oct. 20, 2022

(30) Foreign Application Priority Data

Sep. 19, 2019 (EP) ..... 19198399

(51) Int. Cl.
*B65B 69/00* (2006.01)

(52) U.S. Cl.
CPC ..... *B65B 69/0025* (2013.01)

(58) Field of Classification Search
CPC ..... B65B 69/0025; B65B 69/0033; B65B 69/0091; B65B 69/00; B21C 47/006;
(Continued)

(56) References Cited

U.S. PATENT DOCUMENTS 2,198,644 A * 4/1940 Wettengel ..... B21C 47/24 414/908
3,513,522 A * 5/1970 Thomson ..... A01F 12/14 83/89

(Continued)

FOREIGN PATENT DOCUMENTS

CA 1313991 C 3/1993
CN 103097049 A 5/2013

(Continued)

OTHER PUBLICATIONS

International Search Report and Written Opinion received in International Application No. PCT/EP2020/075195 dated Nov. 19, 2020, 14 pages.

(Continued)

*Primary Examiner* — Gloria R Weeks
*Assistant Examiner* — Mobeen Ahmed
(74) *Attorney, Agent, or Firm* — Liang & Hennessey LLP; Brian Hennessey

(57) ABSTRACT

Coil has been produced by coiling of a strip. The coil has two end faces and a lateral surface, and also a coil eye having an eye axis. The binding bands have a binding band width. Initially, while a first subregion of the lateral surface of the coil, as seen in the direction of the eye axis, is resting on a first rest, those binding bands which, as seen in the direction of the eye axis, surround the coil completely outside the first subregion are removed. Then, while a second subregion of the coil, as seen in the direction of the eye axis, is resting on the first rest or a second rest, those binding bands which were not removed are removed. The first and the second subregion, as seen in the direction of the eye axis, are spaced apart from one another at least by the binding band width.

18 Claims, 10 Drawing Sheets

(58) Field of Classification Search
CPC ... B21C 47/32; Y10S 83/909; Y10T 29/5139; A01F 12/14; B26D 7/27; B26D 1/045; B23P 19/04
See application file for complete search history.

(56) References Cited

U.S. PATENT DOCUMENTS 3,521,347 A * 7/1970 Bentley ..... B65B 69/0025 29/426.3
3,557,591 A * 1/1971 Lind ..... B65B 69/0025 72/196
4,056,186 A * 11/1977 Hill ..... B21B 39/00 198/465.1
4,261,395 A * 4/1981 Gronau ..... B65B 69/0025 140/149
4,399,729 A * 8/1983 Malinowski ..... B23D 31/00 242/562
4,437,223 A * 3/1984 Petros ..... B23D 17/06 83/924
4,835,836 A * 6/1989 van Uitert ..... B65B 69/0025 83/156
5,131,135 A * 7/1992 Gronau ..... B65B 69/0025 83/909
5,199,841 A * 4/1993 Von Gehlen ..... B65B 69/0025 414/412
5,297,329 A * 3/1994 Santin ..... B65B 69/0025 83/156
5,318,399 A * 6/1994 Marom ..... B65B 69/0025 414/412
5,375,316 A * 12/1994 Carlson ..... B65B 69/0025 83/156
5,467,676 A * 11/1995 Hooper ..... B26D 7/27 83/365
6,047,458 A * 4/2000 Merrill ..... B65B 69/0025 83/909
6,115,904 A * 9/2000 Merrill ..... B65B 69/0025 83/909
6,393,688 B1 * 5/2002 Axner ..... B65B 69/0025 83/509
6,401,582 B1 * 6/2002 Noe ..... B65B 69/0025 83/924
6,912,762 B2 * 7/2005 Lile ..... B65B 69/0025 29/709
6,986,233 B1 * 1/2006 Covington ..... B65B 69/0025 53/523
7,152,634 B2 * 12/2006 Peters ..... B65B 69/0025 29/564.3
8,160,748 B2 * 4/2012 Pienta ..... B65B 69/0025 901/47
8,567,293 B2 * 10/2013 Freudenberg ..... B65B 69/0025 83/17
8,667,664 B2 * 3/2014 Norberg ..... B65B 69/0025 83/909
8,807,000 B2 * 8/2014 Norberg ..... B65B 69/0025 83/360
9,079,680 B2 * 7/2015 Vannice ..... B65B 69/0025
9,108,236 B2 8/2015 Jesche et al.
9,289,809 B2 * 3/2016 Cramer ..... B21C 47/24
9,359,097 B2 * 6/2016 Henriksson ..... B65B 69/0033
10,370,131 B2 * 8/2019 Quinones ..... B65B 63/04
10,899,488 B2 * 1/2021 Kivelä ..... B65B 69/0025
2005/0199310 A1 * 9/2005 Peters ..... B65B 69/0025 140/102
2006/0157434 A1 * 7/2006 Dreisbach ..... B21B 39/00 211/151
2013/0256439 A1 * 10/2013 Cramer ..... B21C 47/326 242/363
2014/0260092 A1 * 9/2014 Eno ..... B21C 47/02 53/399
2015/0059145 A1 * 3/2015 McLellan ..... B65B 69/0025 29/426.3
2016/0031579 A1 * 2/2016 Redford ..... B65B 69/0025 53/381.2
2016/0362214 A1 * 12/2016 Steenhoek ..... A01D 87/127
2017/0174372 A1 * 6/2017 Quinones ..... B65B 11/004
2020/0230676 A1 * 7/2020 Hofer ..... B21C 47/24
2023/0312155 A1 * 10/2023 Song ..... B65B 69/0025 53/492

FOREIGN PATENT DOCUMENTS

CN 103224072 A 7/2013
CN 108480881 A 9/2018
CN 109760901 A 5/2019
DE 3331577 A1 4/1985
DE 102004007488 A1 9/2005
JP H07115700 B2 12/1995
JP H0891519 A 4/1996

OTHER PUBLICATIONS

European Search Report received in European Application No. 19198399.8 dated Feb. 11, 2020, 7 pages.

* cited by examiner

AUTOMATED REMOVAL OF BINDING TAPES FROM A COIL

CROSS-REFERENCE TO RELATED APPLICATIONS

The present application is a national phase application of PCT Application No. PCT/EP2020/075195, filed Sep. 9, 2020, entitled "AUTOMATED REMOVAL OF BINDING TAPES FROM A COIL", which claims the benefit of European Patent Application No. 19198399.8, filed Sep. 19, 2019, each of which is incorporated by reference in its entirety.

BACKGROUND OF THE INVENTION

1. Field of the Invention

The present invention is based on a method for removing binding bands from a coil which is produced by coiling of a strip, wherein the coil has two end faces and a lateral surface, and also a coil eye having an eye axis, and the binding bands have a binding band width.

The present invention is furthermore based on a removal installation for removing binding bands from a coil which is produced by coiling of a strip, wherein the coil has two end faces and a lateral surface, and also a coil eye having an eye axis.

2. Description of the Related Art

A finish-rolled strip is usually coiled to form a coil and transported in this form from a finishing train to a further installation, in which the coil is uncoiled again and then the strip is supplied to a further machining operation. The distance over which the coil is transported may be a few 100 m or many km. The further machining operation may be, for example, cold rolling with or without pickling beforehand. Other installations are also possible.

So that the coil as such remains unchanged during transport, in particular outer turns of the coil do not detach from the coil, the coil is bound using binding bands which run around the lateral surface of the coil. Prior to the further machining operation in the further installation, the binding bands have to be removed again. The binding bands are preferably removed in an automated manner.

For this purpose, in the prior art, the coil is positioned on a pair of bottom rolls, the bottom rolls being tapered in those regions in which the binding bands of the coil extend. As a result, it is possible to separate the binding bands in an automated manner and then pull them off from the coil in an automated manner.

The prior-art procedure works very well provided that the binding bands have been positioned exactly at the points where the tapered regions of the bottom rolls are located. However, in practice, this is often not the case. One possible reason for this is for example that after the finish rolling in a finishing train, the coil has been coiled and bound and here the binding bands have been placed at positions A, whereas the further installation is designed for a situation where the binding bands are located at positions B, which differ from the positions A.

If the binding bands are not located at their expected positions, it is indeed possible for the binding bands to be separated in the input region of the further installation, but not to be pulled off from the coil, since the binding bands are clamped between the coil and the bottom rolls. Rather, it is necessary for the binding bands to be manually removed in this case. This is time-consuming and inconvenient.

Document DE331577A discloses an apparatus for separating and discharging a binding band.

SUMMARY OF THE INVENTION

The object of the present invention is to provide possibilities by means of which binding bands can be removed in an automated manner independently of their positioning on the coil.

The object is achieved by a method for removing binding bands from a coil which is produced by coiling of a strip, having the features of the independent claims. The dependent claims provide advantageous configurations of the removal method.

According to the invention, a method for removing binding bands is designed in such a way a) that initially, while a first subregion of the lateral surface of the coil, as seen in the direction of the eye axis, is resting on a first rest, those binding bands which, as seen in the direction of the eye axis, surround the coil completely outside the first subregion are removed, and b) that then, while a second subregion of the coil, as seen in the direction of the eye axis, is resting on the first rest or a second rest, the first and the second subregion, as seen in the direction of the eye axis, being spaced apart from one another at least by the binding band width, those binding bands which were not removed in step a) are removed.

The removal of the binding bands is often incorporated into the transport of the coil from an input region of a further installation to a processing region of the further installation. The coil is transported from the input region of the further installation to the processing region of the further installation in that the coil is conveyed, by means of an advancing bar, in several stages in a substantially horizontal conveying direction from a first stationary saddle region to a second stationary saddle region, from the second stationary saddle region to a third stationary saddle region etc. up to a last stationary saddle region, such that the coil alternately rests on one of the saddle regions and the advancing bar. In this case, it is possible for a predetermined one of the saddle regions to correspond to the first rest, the advancing bar to correspond to the second rest, step a) to be carried out while the coil is resting on the predetermined saddle region, and step b) to be carried out while the coil is being conveyed from the predetermined saddle region to the subsequent saddle region by means of the advancing bar. Alternatively, it is possible for the advancing bar to correspond to the first rest, a predetermined one of the saddle regions to correspond to the second rest, step a) to be carried out while the coil is being conveyed from the preceding saddle region to the predetermined saddle region by means of the advancing bar, and step b) to be carried out while the coil is resting on the predetermined saddle region.

For example, it is possible that, as seen in the direction of the eye axis, the first subregion contains the edge regions of the lateral surface of the coil which adjoin the two end faces, and the second subregion contains a central region of the coil, said central region being spaced apart from both end faces. In this case, the coil is therefore "outwardly" supported in step a) so that the "inwardly" arranged binding bands can be removed in an automated manner, and then "inwardly" supported in step b) so that the "outwardly" arranged binding bands can be removed in an automated manner. Alternatively, the reverse procedure is also possible, that the first subregion thus contains the central region of the coil, and the second subregion contains the two edge regions of the coil. Other procedures are also possible, for example that the coil in the steps a) and b) is supported once on the outside left, in the center and on the outside right, and once on the inside left and on the inside right.

In the context of the removal method according to the invention, the eye axis may be oriented substantially orthogonally with respect to the conveying direction. This is in contrast to the prior art, in which the eye axis is usually oriented in the conveying direction. This procedure entails, in particular, the advantage that the coil does not have to be rotated through 90° about a vertically extending axis at the transition to the processing region of the further installation, but rather can undergo further processing directly. However, configurations in which the eye axis is oriented substantially in the conveying direction are also possible.

Preferably, prior to carrying out step a), the coil is rotated about its eye axis so that a strip head of the strip has a predetermined orientation with respect to a vertical plane containing the eye axis. This makes it possible to avoid a situation where the coil "springs open", that is to say the outermost turn comes loose from the coil, after the binding bands have been released and removed.

It is often advantageous for a diameter of the coil to be determined by measurement. This can be expedient in particular in order to adapt subsequent machining operations in dependence on the diameter. Preferably, the diameter of the coil is determined while the first subregion of the coil is resting on the first rest in step a) and/or the second subregion of the coil is resting on the first or the second rest in step b).

The object is furthermore achieved by a removal installation having the features of the claims. The dependent claims provide advantageous configurations of the removal installation.

According to the invention, a removal installation of the type mentioned at the beginning is configured

- in that the removal installation comprises either a first rest or the first rest and additionally a second rest,
- in that the first rest is designed in such a way that, as seen in the direction of the eye axis, a first subregion of the lateral surface of the coil can rest on a first rest at a first point in time,
- in that either the first rest or the second rest is designed in such a way that, as seen in the direction of the eye axis, a second subregion of the lateral surface of the coil can rest on the first rest or on the second rest at a second point in time following the first point in time,
- in that in both cases the first and the second subregion, as seen in the direction of the eye axis, are spaced apart from one another, and
- in that the removal installation comprises a removal device, by means of which the binding bands which, as seen in the direction of the eye axis, surround the coil completely outside the first subregion can be removed while the first subregion of the lateral surface of the coil is resting on the first rest, and by means of which the rest of the binding bands which surround the coil can be removed while the second subregion of the lateral surface of the coil is resting on the first or the second rest,
- in that the removal installation comprises a first stationary saddle region, a second stationary saddle region etc. up to a last stationary saddle region,
- in that the removal installation comprises an advancing bar, by means of which the coil can be conveyed in several stages in a substantially horizontal conveying direction from the first stationary saddle region to the second stationary saddle region, from the second stationary saddle region to the third stationary saddle region etc. up to the last stationary saddle region, such that the coil alternately rests on one of the saddle regions and the advancing bar during the conveying operation,
- in that either a predetermined one of the saddle regions (19) corresponds to the first rest and the advancing bar corresponds to the second rest or the advancing bar corresponds to the first rest and the predetermined saddle region corresponds to the second rest, and
- in that the removal device can be operated at least in the region of the predetermined saddle region.

Many advantageous configurations correspond to those of the method. Reference can therefore frequently be made to the above statements.

If the removal of the binding bands is incorporated into the transport of the coil from an input region to a processing region of a further installation, it is possible for a predetermined one of the saddle regions to correspond to the first rest and the advancing bar to correspond to the second rest. Alternatively, it is possible for the advancing bar to correspond to the first rest and the predetermined saddle region to correspond to the second rest. In both cases, it may be sufficient for the removal device to be operable only in the region of the predetermined saddle region.

The removal device, by means of which the binding bands are removed, may be designed in particular as a robot.

Preferably, the removal device comprises an optical detection device for detecting the binding bands which surround the coil. As a result, the binding bands can be detected in a particularly simple and reliable manner.

BRIEF DESCRIPTION OF THE DRAWINGS

The invention ein: The characteristics, features and advantages of this invention that are described above and the manner in which they are achieved will become clearer and more distinctly comprehensible in connection with the description of the exemplary embodiments that follows, said exemplary embodiments being explained in more detail in conjunction with the drawings, in which, in a schematic illustration.

DETAILED DESCRIPTION

Figure 1:
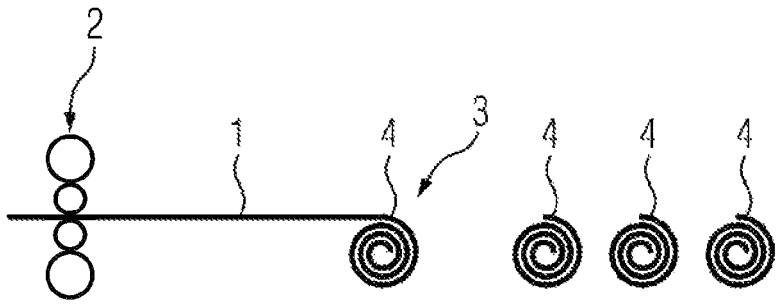
FIG. 1 shows a rolling installation.

FIG. 1 to According to FIG. 1, a metal strip 1 is rolled in a rolling installation. Only the last roll stand 2 of the rolling installation is illustrated. After the rolling, the metal strip 1 is coiled to form a coil 4 by means of a coiler installation 3. The coiled coils 4 are then provided with binding bands 5 (see FIG. 2) and removed from the rolling installation.

Figure 2:
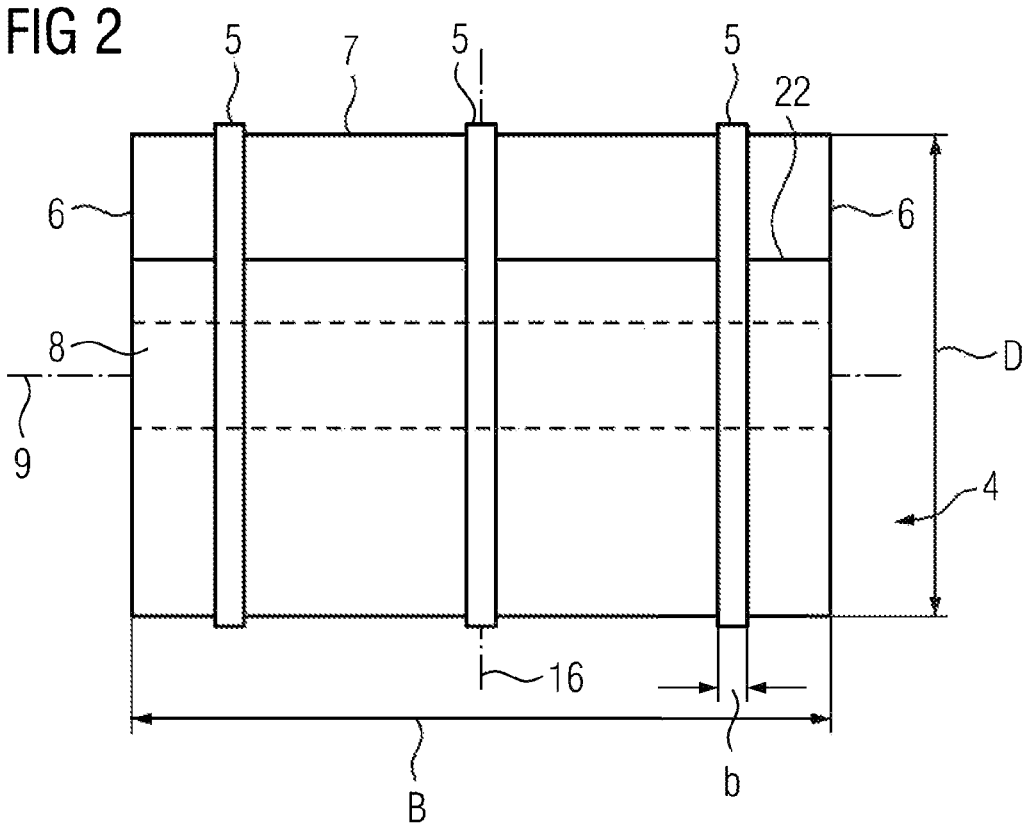
FIG. 2 shows a plan view of a coil.
Figure 3:
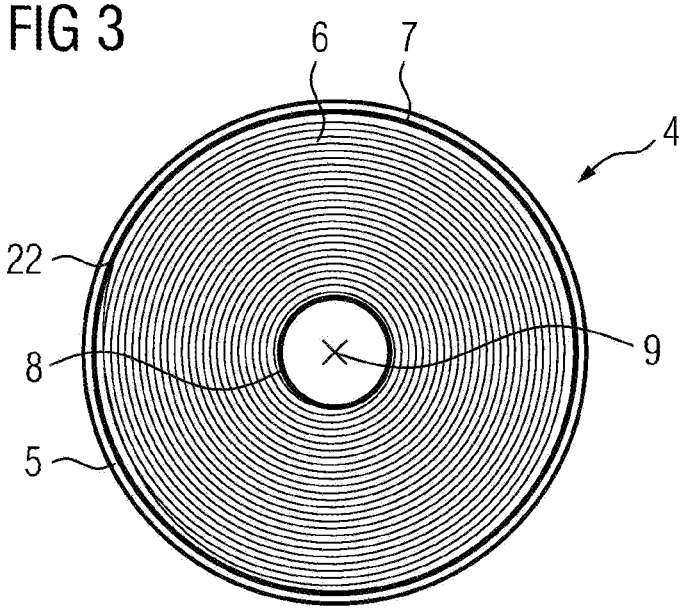
FIG. 3 shows a side view of the coil of FIG. 2.

FIGS. 2 and 3 show a coil 4 after the binding. The coil 4 has substantially a cylindrical form. According to FIGS. 2 and 3, the coil 4 thus has two end faces 6 and a lateral surface 7. The coil 4 furthermore has a coil eye 8 having an eye axis 9. As a general rule, the eye axis 9 is oriented horizontally, insofar as the procedure according to the invention is concerned. The coil 4 has a diameter D and a coil width B. The binding bands 5 extend around the coil 4 on the lateral surface 6. They have a binding band width b. The binding band width b is considerably smaller than the coil width B. For example, the binding band width b may be 4 cm, whereas the coil width B may for example be 1 m. The number of binding bands 5 can be according to requirements. It is usually between one and four. According to the illustration in FIG. 2, it is for example possible for three binding bands 5 to be present.

Figure 4:
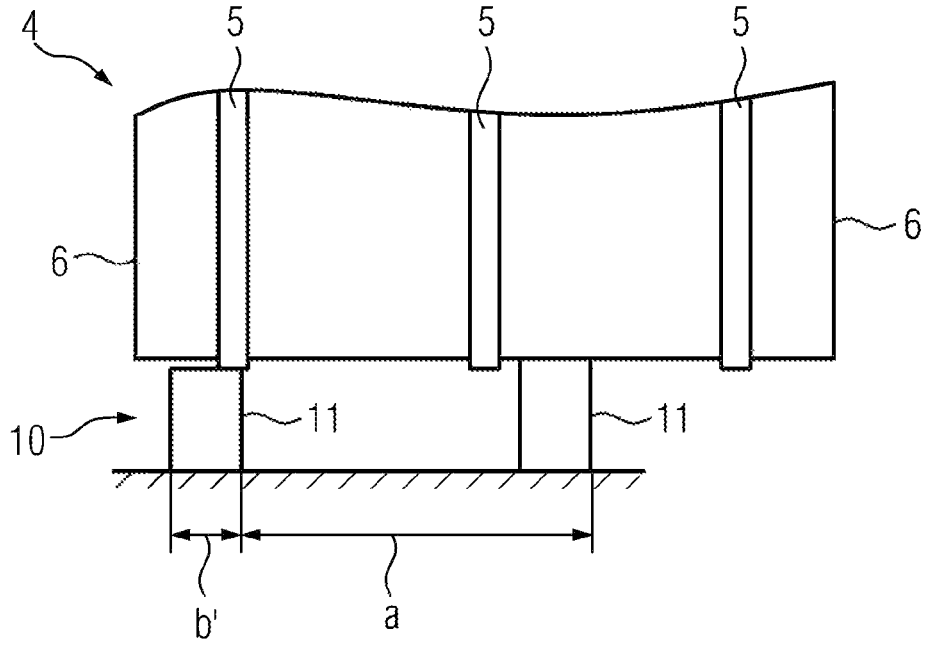
FIG. 4 shows a side view of a coil on a first rest.

For the automated removal of the binding bands 5 from the coil 4, a first subregion of the lateral surface 7 of the coil 4 initially rests on a first rest 10, as per FIG. 4. It goes without saying that the first subregion extends only over a part of the circumference of the coil 4, as seen in a circumferential direction about the eye axis 9. In particular, however, as seen in the direction of the eye axis 9, the first subregion extends only over a part of the coil width B, in accordance with the illustration in FIG. 4. For example, the first rest 10 may comprise two supports 11 which for their part, as seen in the direction of the eye axis 9, have a respective support width b' and, as seen in the direction of the eye axis 9, are remote from one another by a predetermined support spacing a. By way of example, the two supports 11 may have a support width b' of 10 cm and be spaced apart from one another by 50 cm. Here, too, the stated numerical values are obviously to be understood as purely exemplary.

Figure 5:
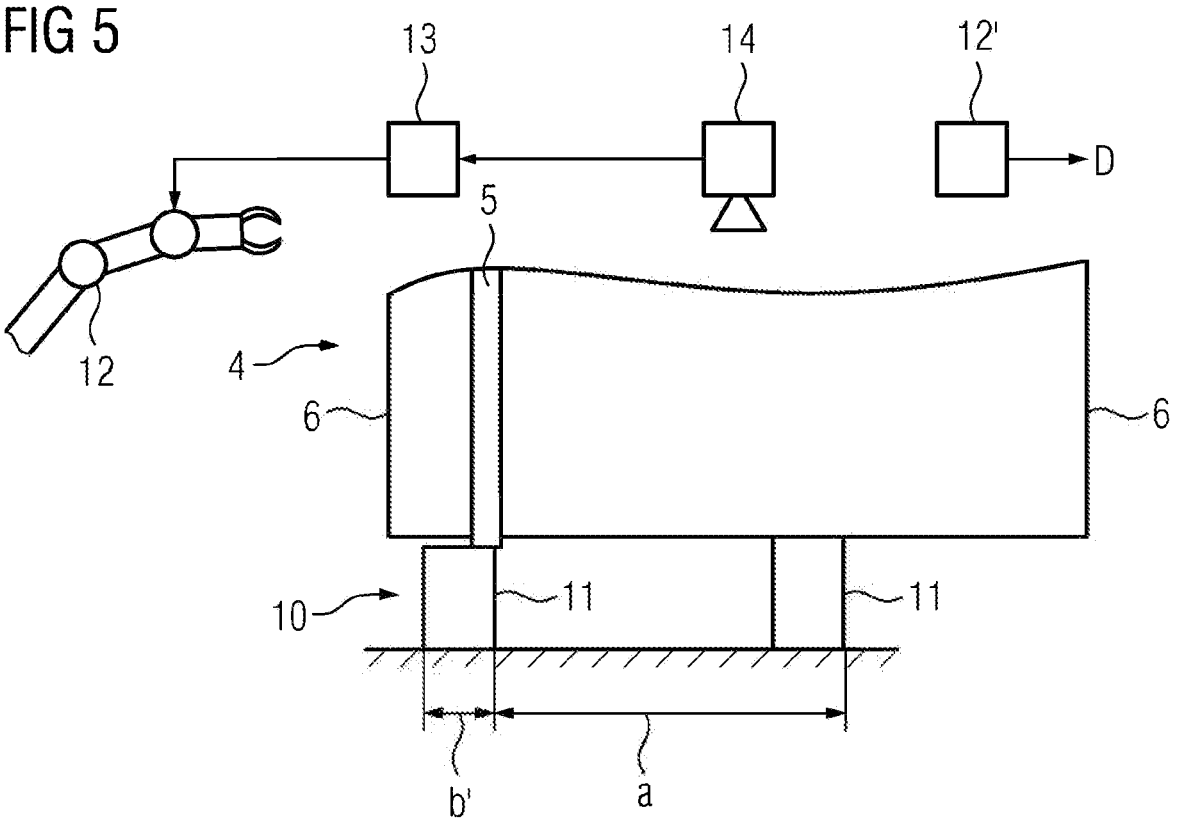
FIG. 5 shows the coil of FIG. 4 after some of the binding bands have been removed.

In this state, that is to say when the coil 4 has been placed onto the first rest 10, it is initially possible for those binding bands 5 which, as seen in the direction of the eye axis 9, surround the coil 4 completely outside the first subregion to be removed by means of a removal device 12, in accordance with the illustration in FIG. 5. If, for example, the coil 4 rests on the supports 11 in such a way that the end face 6 on the left in FIG. 4 has a spacing of 5 cm from the left-hand support 11, and consequently, in the case of a coil width B of 1 m, the right-hand end face 6 has a spacing of 35 cm from the right-hand support 11, and furthermore—in a purely exemplary manner—the binding band width b is 4 cm, then it is possible in this state for all of the binding bands 5 whose center has a spacing of either between 17 cm and 53 cm or more than 67 cm from the left-hand end face 6 to be removed. As a precaution, a certain tolerance can also be taken into account, such that for example only binding bands 5 whose center has a spacing of either between 19 cm and 51 cm or more than 69 cm from the left-hand end face 6 are removed.

Thus, if a total of three binding bands 5 are present in accordance with the illustration in FIG. 2, for example, the center of the two outer binding bands 5 in each case being at a spacing of 15 cm from the adjacent end face and the center of the central binding band 5 being at an equidistant spacing from both end faces 6, then in this state the left-hand binding band 5 is in fact clamped by the left-hand support 11 and therefore cannot be removed in this state. By contrast, the central and the right-hand binding band 5 can be removed. FIG. 5 shows this state in which the two aforementioned binding bands 5 have been removed.

Figure 6:
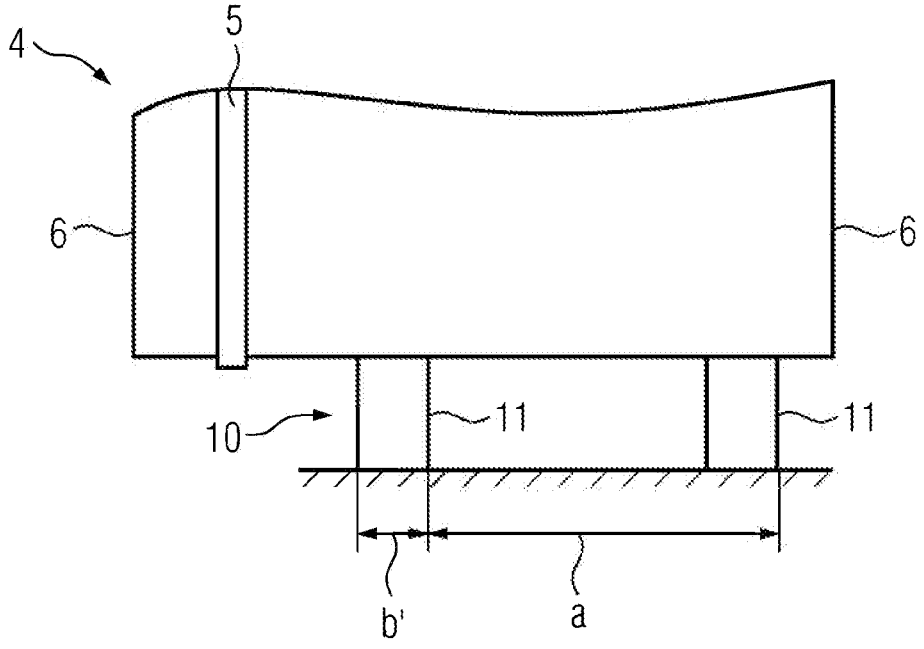
FIG. 6 shows a side view of the coil of FIG. 5 on the first rest.

At a later point in time, that is to say after those binding bands 5 which can be removed in the state according to FIG. 4 have been removed, a second subregion of the coil 4 then rests on the first rest 10. FIG. 6 shows this state. Just like the first subregion, the second subregion extends only over a part of the circumference of the coil 4, as seen in the circumferential direction about the eye axis 9. In particular, however, as seen in the direction of the eye axis 9, the second subregion likewise extends only over a part of the coil width B, in accordance with the illustration in FIG. 6. It is crucial that the first and the second subregion, as seen in the direction of the eye axis 9, are spaced apart from one another at least by the binding band width b. For example, the coil 4 may rest on the supports 11 in such a way that the end face 6 on the right in FIG. 4 has a spacing of 5 cm from the right-hand support 11, and consequently, in the case of a coil width B of 1 m, the left-hand end face 6 has a spacing of 35 cm from the left-hand support 11. In this state, those binding bands 5 which were previously not removed can then be removed by means of the removal device 12.

Figure 7:
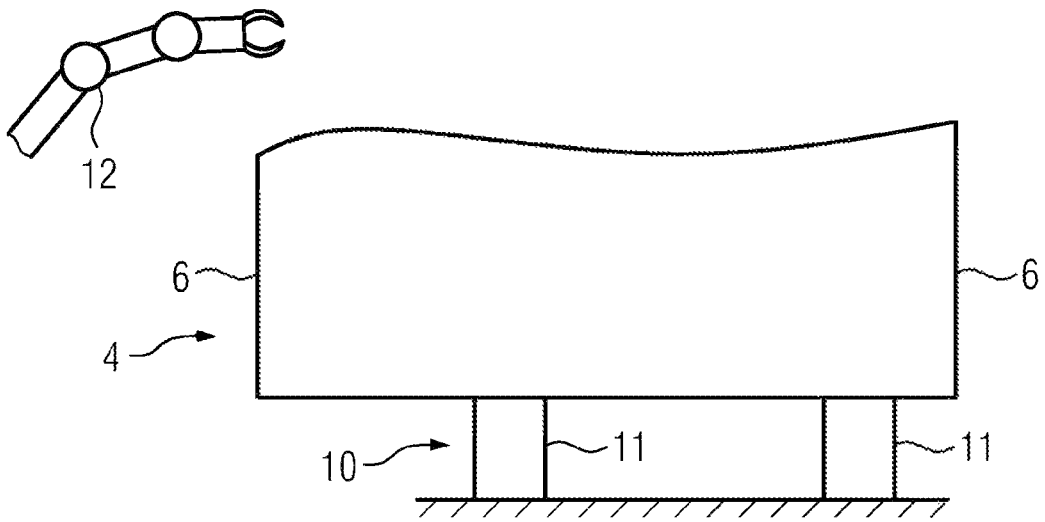
FIG. 7 shows the coil of FIG. 6 after the rest of the binding bands have been removed.

Based on the previously stated, purely exemplary numerical values, it is thus possible for all of the binding bands 5 whose center has a spacing of either less than 33 cm or between 47 cm and 83 cm from the left-hand end face 6 to then be removed. As a precaution, a certain tolerance can again be taken into account, such that for example only binding bands 5 whose center has a spacing of either less than 31 cm or between 49 cm and 81 cm from the left-hand end face 6 are removed. FIG. 7 shows this state in which the rest of the binding bands 5 have also been removed.

Figure 8:
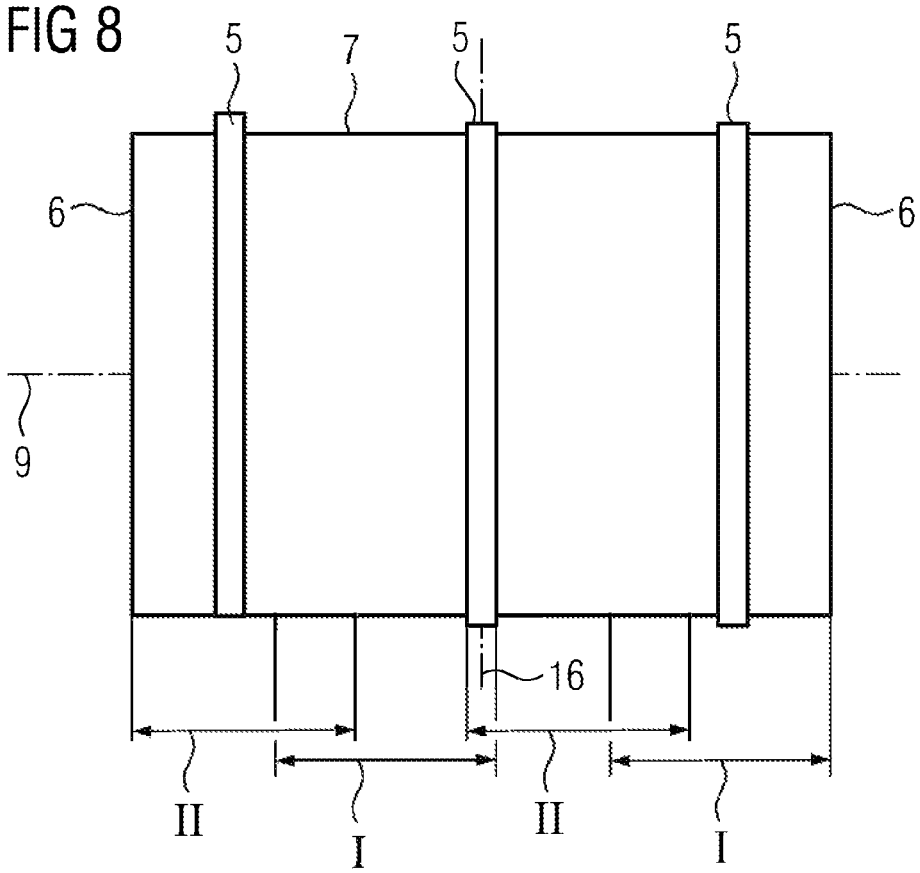
FIG. 8 shows the coil of FIGS. 4 to 7 and its binding bands.

FIG. 8 illustrates this once again. FIG. 8 depicts the coil 4 and its binding bands 5. FIG. 8 furthermore depicts those regions of the lateral surface 7 from which the binding bands 5 can be removed in the first and in the second state. The regions for the first state are denoted by I in FIG. 8, and the regions for the second state by II. It can be seen that the regions as a whole cover the coil 4 over its entire width B in an uninterrupted manner.

The removal of the binding bands 5 as such can also be performed in the same way as in the prior art. The associated removal device 12—that is to say the device which removes the binding bands 5 from the coils 4—can thus also be designed as required. For example, the removal device 12 may be designed as a robot, as schematically indicated in FIGS. 5 and 7. Furthermore, it is possible for the positions of the binding bands 5 on the coil 4 to be specified to a control device 13 for the removal device 12 by an operator (usually a numerical control) or to be known in some other way. However, the removal device 12 preferably has an optical detection device 14, by means of which the binding bands 5 which surround the coil 4 are automatically detected. The optical detection device 14 may be designed, for example, as a laser scanner. If the optical detection device 14 is present, the data detected by the optical detection device 14 (for example images) or evaluation results based thereon are transmitted to the control device 13 by said optical detection device. The control device 13 then takes the data or evaluation results transmitted to it into account during the control of the removal device 12.

Preferably, the removal device 12 is furthermore assigned a measuring device 12'. By means of the measuring device 12', it is in particular possible for the coil diameter D to be determined and to be output to a control device (not illustrated in the FIG). During the measurement-based determination of the coil diameter D, it is alternatively possible for the first subregion or the second subregion of the coil 4 to rest on the first rest 10.

A further possible configuration of the removal installation according to the invention is explained below in conjunction with FIGS. 9 and 10. This configuration differs from the removal installation explained above in conjunction with FIGS. 4 to 8 by the adjustment of the configuration of the supports 11 and the manner in which the coil 14 rests on the supports 11. The rest of the statements still apply.

Figure 9:
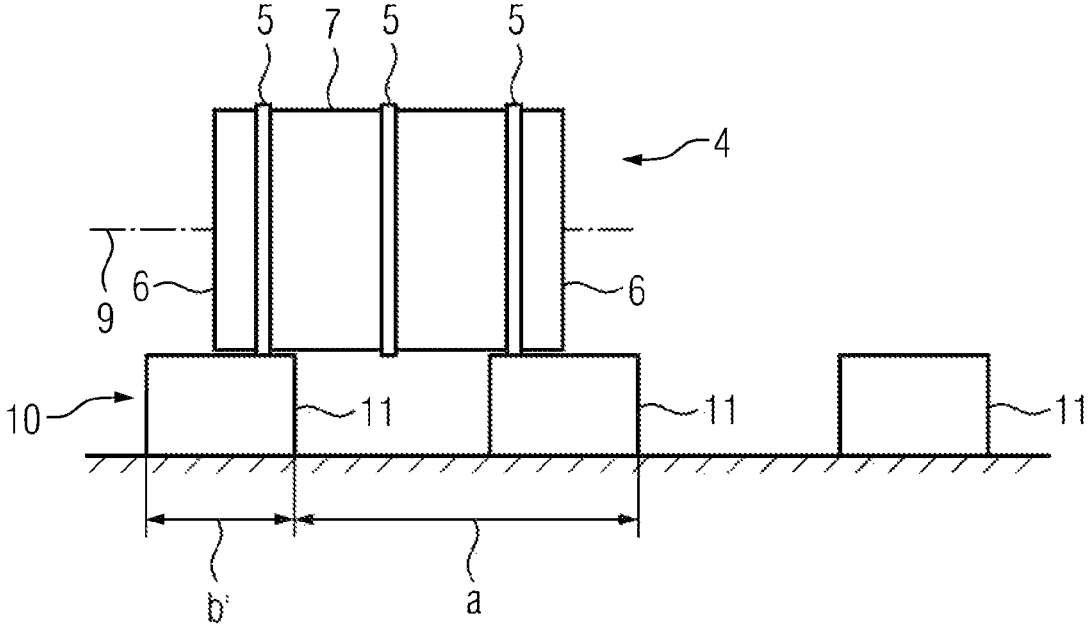
FIG. 9 shows a side view of a coil on a first rest.
Figure 10:
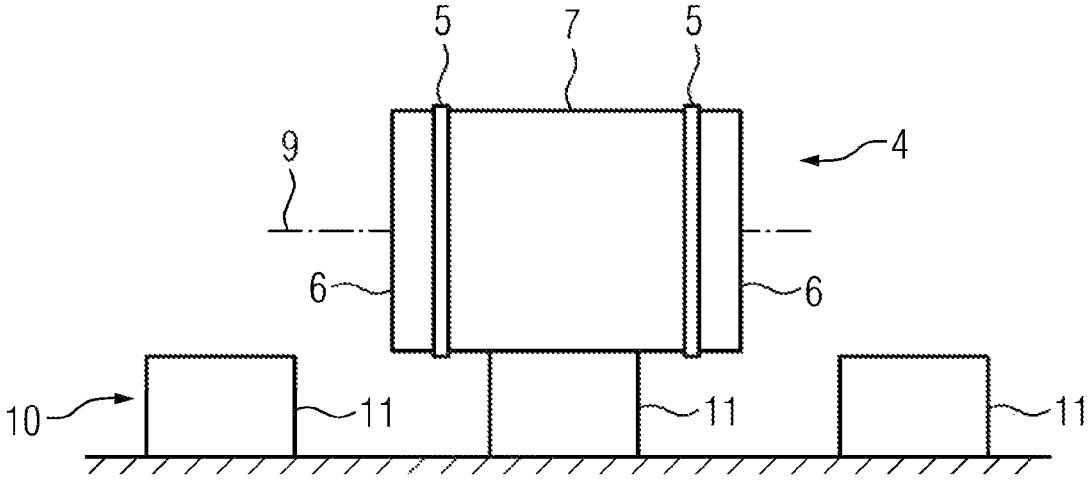
FIG. 10 shows a further side view of a coil on a first rest.

According to FIGS. 9 and 10, the supports 11 form a sequence of supports 11. As seen in the direction of the eye axis 9, the supports 11 have a relatively large support width b'. Said support width may at most be slightly smaller than half the support spacing a. The theoretical maximum is half the support spacing a minus half the binding band width b'. For example, the support width b' may be 40 cm in the case of a support spacing a of 1 m.

According to FIG. 9, the coil 4 initially lies on the supports 11 in such a way that the edge regions of the lateral surface 7 of the coil 4 which adjoin the two end faces 6 rest on adjacent supports 11. The corresponding first subregion thus contains the edge regions of the lateral surface 7 of the coil 4 which adjoin the two end faces 6. In this state, those binding bands 5 which are located outside the two edge regions of the coil 4 are removed. Using the above numerical examples (coil width B 1 m, binding band width b 4 cm, support width b' 40 cm and support spacing a 1 m), it is thus possible for all of the binding bands 5 whose center has a spacing of between 22 cm and 78 cm from the left-hand end face 6 to be removed. If a certain tolerance is also additionally taken into account, it is for example possible for all of the binding bands 5 whose center has a spacing of between 24 cm and 76 cm from the left-hand end face 6 to be removed. In the example shown in FIGS. 9 and 10, it is thus for example initially possible for only the central binding band 5 to be removed.

At a later point in time, the coil 4 then rests on the supports 11 in such a way that the central region of the coil 4 rests on the supports 11, as per FIG. 10. The central region of the coil 4 is the region which is spaced apart from both end faces 6. Preferably, the central region contains, in particular, the region which is equidistantly spaced apart from both end faces 6. The corresponding second subregion contains the central region of the lateral surface 7 of the coil 4, said central region being spaced apart from both end faces 6. In this state, the rest of the binding bands 5 which have hitherto not yet been removed are removed. Using the above numerical examples, it is thus possible for all of the binding bands 5 whose center has a spacing of less than 28 cm from one of the two end faces 6 to be removed. If a certain tolerance is also additionally taken into account, it is for example possible for all of the binding bands 5 whose center has a spacing of less than 26 cm from one of the two end faces 6 to be removed. In the example shown in FIGS. 9 and 10, it is thus for example then possible for the two outer binding bands 5 to be removed.

The advancing step distance is thus exactly or at least approximately half as great as the support spacing a. This coordination of the advancing step distance with the support spacing a thus makes it possible to remove all of the binding bands 5 in two successive advancing steps. This can be seen from FIG. 11, which depicts those regions, denoted by I and II, in which the binding bands 5 can be removed in the state according to FIG. 9 and in the state according to FIG. 10. It can be seen that the regions as a whole cover the coil 4 over its entire width B in an uninterrupted manner.

It goes without saying that the order in which the coil 4 rests on the supports 11 can also be reversed. It is thus firstly possible for the state according to FIG. 10 to be assumed and then the state according to FIG. 9. In both cases, the procedure according to FIGS. 9 and 10 has the advantage that a plurality of coils 4 can be transported sequentially in succession through the removal installation, that is to say, for example, that a coil 4 is continually transported in from the left and is transported out to the right.

To the extent explained hitherto, the same rest 10 is used for both states in which a subregion of the respective coil 4 rests on a rest, that is to say the first rest 10 according to the terminology of the present invention. However, it is also possible for the coil 4 to initially rest on a first rest 11 in the first state and then on a second rest 15 in the second state (see FIGS. 12 to 15). This procedure is explained in more detail below in conjunction with FIGS. 12 to 15. This configuration differs from the removal installations explained above in conjunction with FIGS. 4 to 8 and 9 to 11 by the adjustment of the configuration of the supports 11 and the manner in which the coil 14 rests on the supports 11. The rest of the statements still apply. Insofar as the measurement-based detection of the coil diameter D is concerned, this can alternatively be carried out while the first subregion of the coil 4 is resting on the first rest 10 or the second subregion of the coil is resting on the second rest 15.

Figure 12:
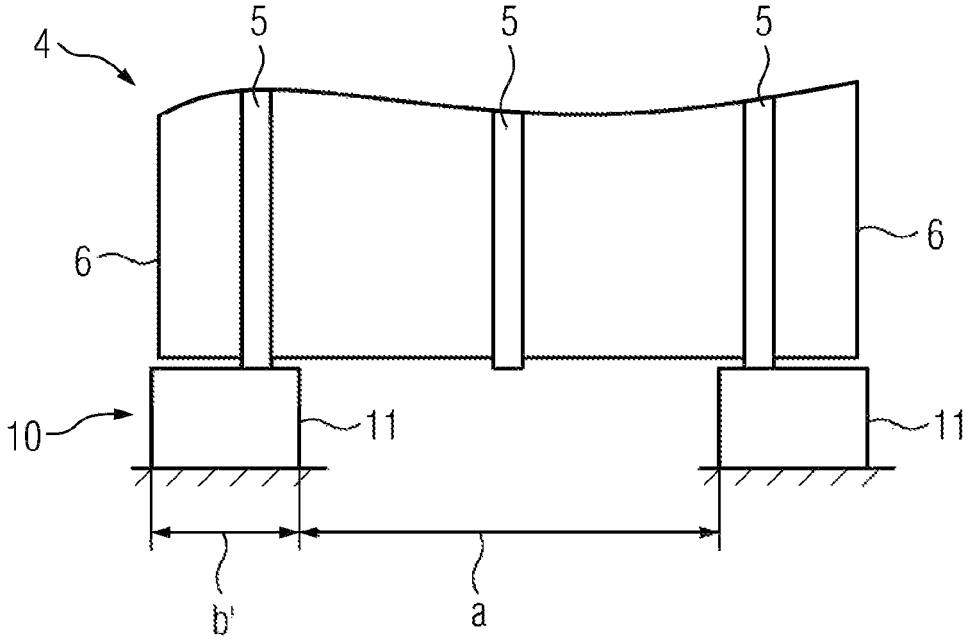
FIG. 12 shows a side view of a coil on a first rest.

According to FIG. 12, the first subregion of the lateral surface 7 of the coil 4 initially rests on the first rest 10. As seen in the circumferential direction about the eye axis 9, the first subregion again extends only over a part of the circumference of the coil 4 and also, as seen in the direction of the eye axis 9, only over a part of the coil width B. For example, as before, the first rest 10 may comprise two supports 11 which for their part, as seen in the direction of the eye axis 9, have a respective support width b' and, as seen in the direction of the eye axis 9, are from one another by a predetermined support spacing a. By way of example, the two supports 11 may have a support width b' of 30 cm and be spaced apart from one another by a support spacing a of 90 cm. The stated numerical values are again to be understood only as purely exemplary.

Figure 13:
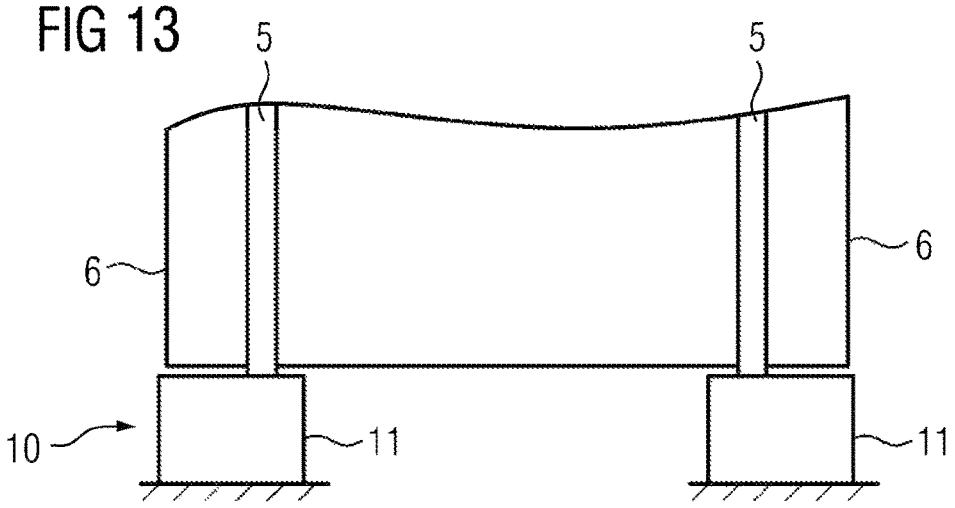
FIG. 13 shows the coil of FIG. 12 after some of the binding bands have been removed.

In this state, that is to say when the coil 4 has been placed onto the first rest 10, it is initially possible for those binding bands 5 which, as seen in the direction of the eye axis 9, surround the coil 4 completely outside the first subregion to be removed by means of the removal device 12. If, for example, the coil 4 is placed centrally onto the supports 11 so that a coil central axis 16 is at an equidistant distance from both supports 11, then it is possible in this state for all of the binding bands 5 which are arranged outside of the regions defined by the two supports 11 (plus the binding band width b) to be removed. In the specific configuration according to FIGS. 12 and 13, this is only the central binding band 5. FIG. 13 shows this state in which the central binding band 5 has been removed.

Figure 14:
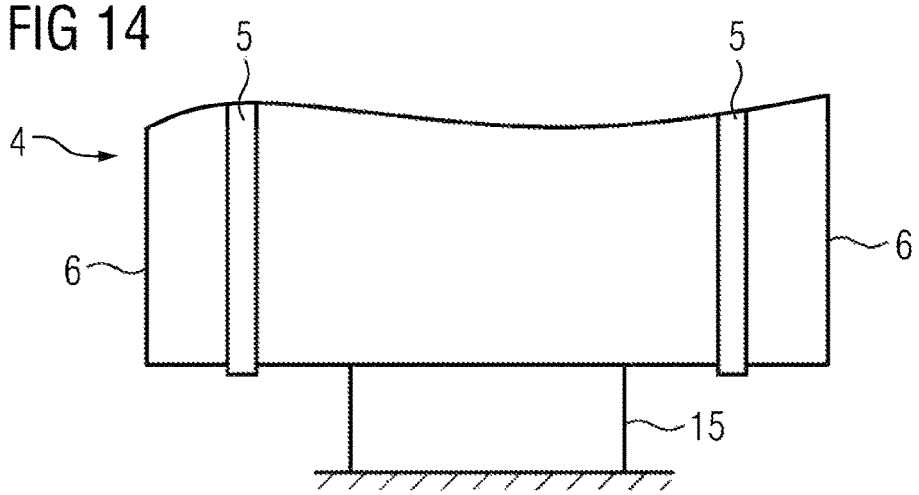
FIG. 14 shows a side view of the coil of FIG. 13 on a second rest.

After those binding bands 5 which can be removed in the state according to FIG. 12 have been removed, a second subregion of the coil 4 then rests on the second rest 15, in accordance with the illustration in FIG. 14. The second rest 15 may be designed, for example, as an individual support which extends, as seen in the direction of the eye axis 9, over a certain length. The length of the second rest 15 has to be selected in such a way that it is smaller than the support spacing a of the two supports 11 minus double the width b of the binding band and additionally minus the support width b'. For example, in the case of a support spacing a of 90 cm, a support width b' of 20 cm and a binding band width b of 4 cm, the second rest 15 should extend at most over 62 cm as seen in the direction of the eye axis 9. In practice, the value is selected to be smaller, such that the second rest 15 extends for example over 40 cm or 50 cm as seen in the direction of the eye axis 9.

Figure 15:
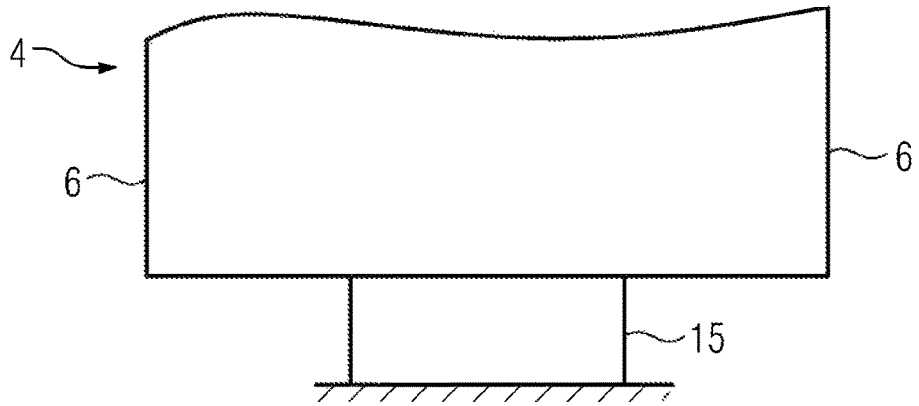
FIG. 15 shows the coil of FIG. 14 after the rest of the binding bands have been removed.

At a point in time after binding bands 5 have been removed in the state according to FIG. 13, the coil 4 thus rests centrally on the second rest 15, with the result that the coil 4 thus protrudes on both sides beyond the second rest 15 in an exactly or at least substantially equidistant manner, and this equates to the two end faces 6 being spaced apart from the second rest 15 in an exactly or at least substantially equidistant manner FIG. 14 shows this state. In this state, those binding bands 5 which were not removed in the state according to FIG. 12 can be removed. FIG. 15 shows the state in which all of the binding bands 5 have then been removed.

Figure 11:
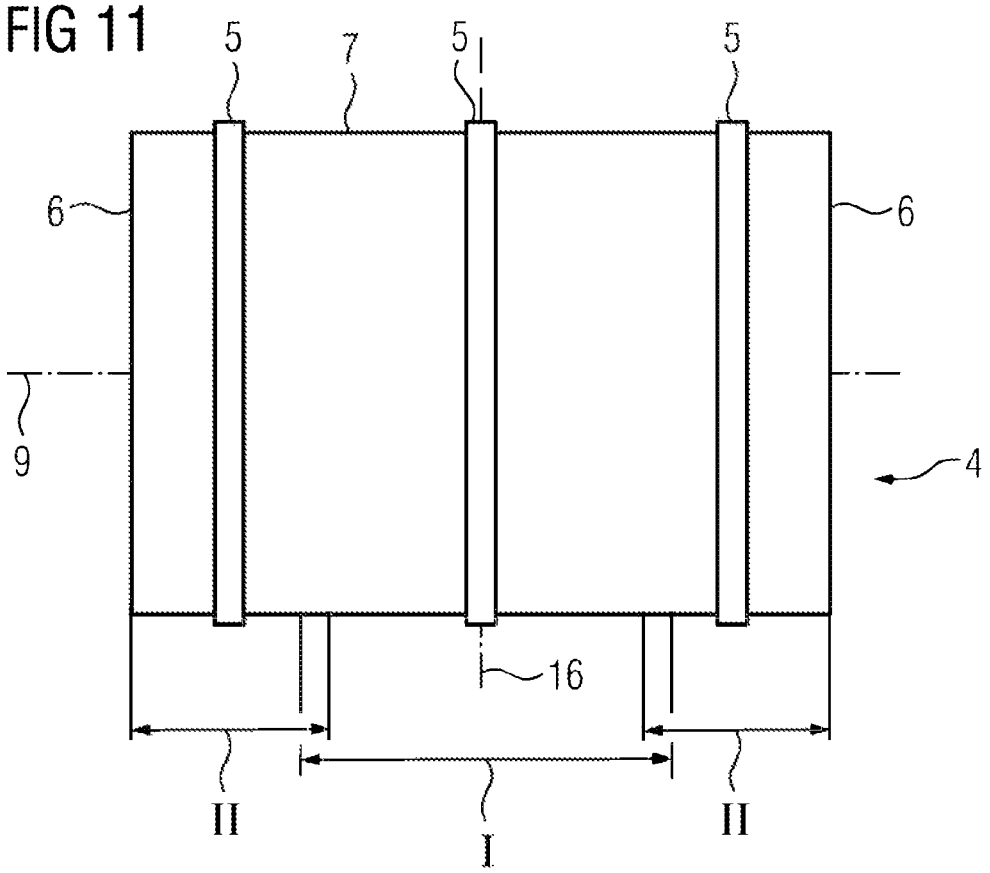
FIG. 11 shows the coil of FIGS. 9 and 10 and its binding bands.

The procedure according to FIGS. 12 to 15 is therefore similar to the procedure according to FIGS. 9 to 11. The difference is that in the procedure according to FIGS. 12 to 15, the coil 4 successively rests on rests 10, 15 that differ from one another, specifically on the first rest 10 and on the second rest 15, whereas in the procedure according to FIGS. 9 to 11, the coil 4 rests on the same rest 10 both times, specifically on the first rest 10.

Figure 16:
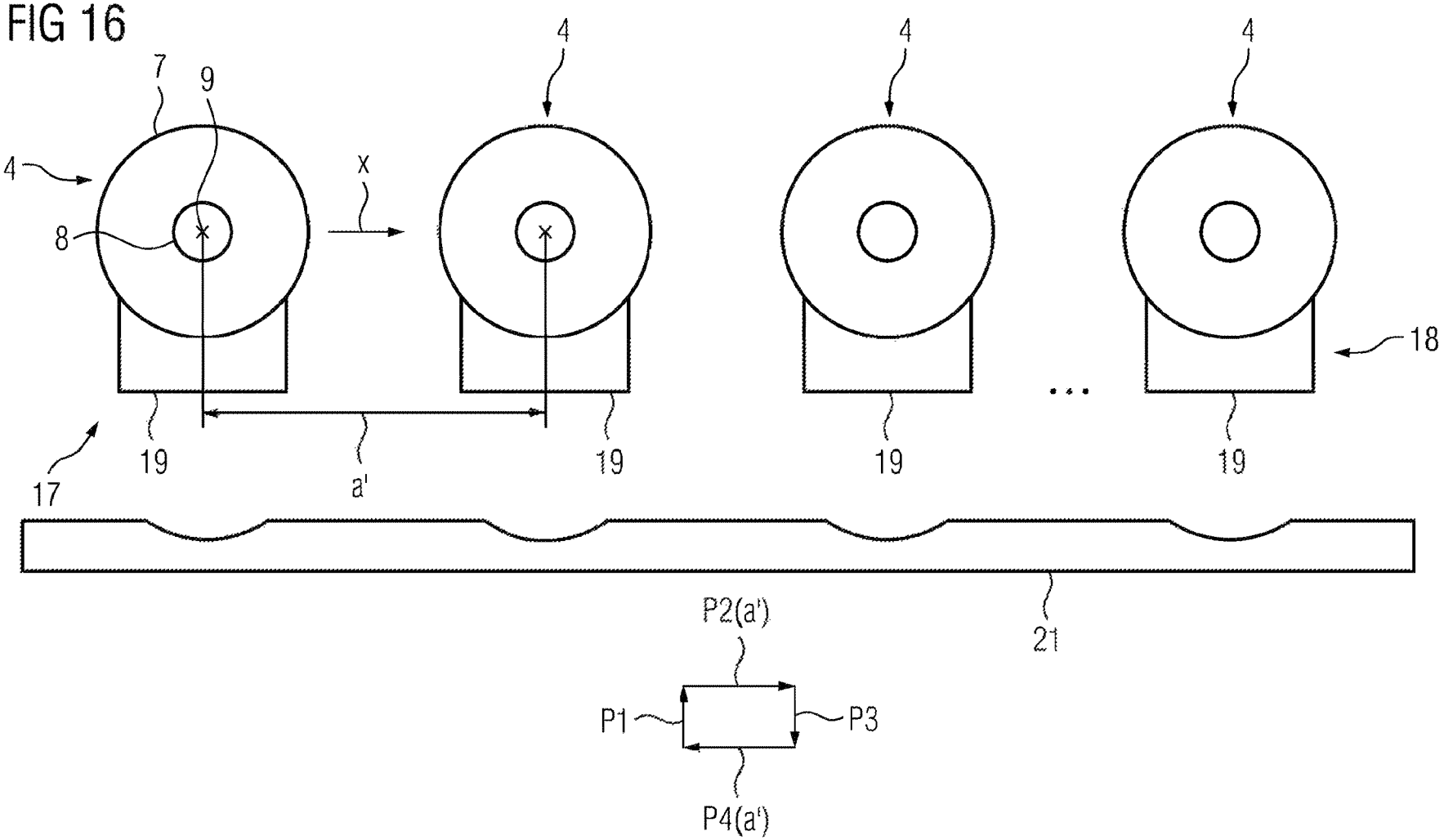
FIG. 16 shows a transport aisle from the side.
Figure 17:
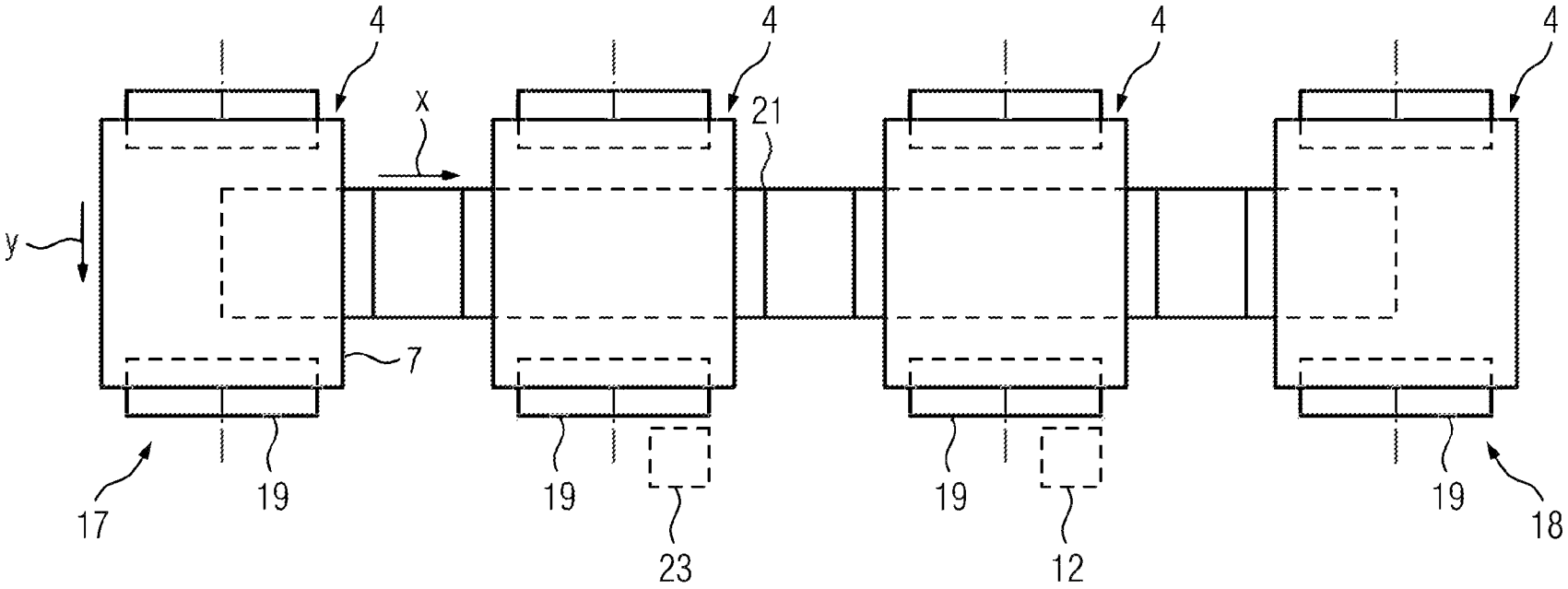
FIG. 17 shows the transport aisle of FIG. 16 from above.
Figure 18:
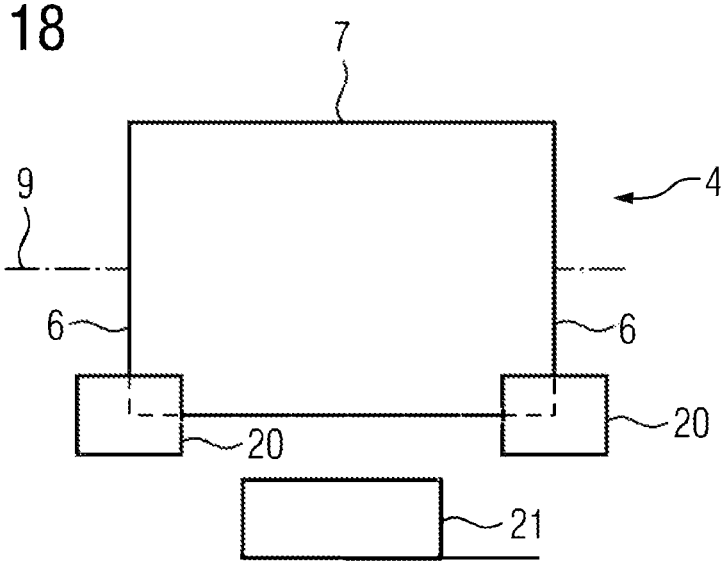
FIG. 18 shows a view of an individual saddle region.

In many cases, the removal of the binding bands 5, in accordance with the illustration in FIGS. 16 and 17, is incorporated into the transport of the coils 4 from an input station 17 to a further-processing station 18. In this case, a transport aisle from the input station 17 to the further-processing station 18 comprises a plurality of saddle regions 19. The saddle regions 19 are stationary. They are arranged behind one another as seen in a conveying direction x. As a general rule, the conveying direction x runs horizontally or at least substantially horizontally. In accordance with the illustration in FIG. 18, the saddle regions 19 generally each comprise two rest regions 20, which are spaced apart from one another in a likewise horizontal or at least substantially horizontal transverse direction y which is oriented orthogonally with respect to the conveying direction x.

The saddle regions 19 have a spacing a'— calculated in each case from the center of the respective saddle region 19 to the center of the subsequent saddle region 19. In order to convey the coil 4 (or all of the coils 4 arranged in the transport aisle), the corresponding coil 4 is initially placed onto the foremost saddle region 19, that is to say onto the saddle region 19 illustrated on the left in FIGS. 16 and 17, by means of a crane (not illustrated), for example. The coil 4 is then conveyed from this saddle region 19 to the next saddle region 19 etc. up to the furthest saddle region 19 by means of an advancing bar 21. As seen in the transverse direction y, the advancing bar 21 is arranged between the rest regions 20 of the saddle regions 19. The advancing step distance of the advancing bar 21 corresponds to the spacing a' of the saddle regions 19 from one another.

In order to convey the coils 4, the advancing bar 21 is thus raised so that it raises the coils 4 resting on the saddle regions 19. This is indicated by an arrow P1 in FIG. 16. Thus, the coils 4 then rest on the advancing bar 21. In this state, the advancing bar 21 is moved to the right. This is indicated by an arrow P2 in FIG. 16. The addition of a' is intended to indicate that the advancing bar 21 is moved to the right by its advancing step distance. Next, the advancing bar 21 is lowered so that the advancing bar 21 lowers the coils 4 resting on it onto the saddle regions 19. The coils 4 have thus been moved along by one saddle region 19. The lowering operation is indicated by an arrow P3 in FIG. 16. Thus, the coils 4 then rest on the saddle regions 19 again. Finally, the advancing bar 21 is moved to the left. This is indicated by an arrow P4 in FIG. 16. The addition of a' is again intended to indicate that the advancing bar 21 is moved to the right by its advancing step distance. The cycle by which the coils 4 are conveyed from a certain saddle region 19 to the respectively next saddle region 19 has thus been completed. As a result, the coil 4 is thus conveyed, by means of the advancing bar 21, in several stages in the conveying direction x from the first saddle region 19 to the second saddle region 19, from there to the third stationary saddle region 19 etc. up to the last saddle region 19. In an individual conveying step, the coil 4 is conveyed onward in each case by the spacing a'. During the conveying from saddle region 19 to saddle region 19, the coil 4 rests on the advancing bar 21. Between conveying operations, the coil 4 rests in each case on one of the saddle regions 19.

It is readily apparent that the rest regions 20 of one of the saddle regions 19 can correspond to the supports 11 of the configuration according to FIGS. 12 to 15, and thus the corresponding saddle region 19 can correspond to the first rest 10. It is furthermore likewise readily apparent that the advancing bar 21 can correspond to the second rest 15 of the configuration according to FIGS. 12 to 15. In the configuration according to FIGS. 16 to 18, it is thus initially possible for the binding bands 5 which are arranged relatively far toward the inside to be removed while the coil 4 is resting on one of the saddle regions 19. While the coil 4 is resting on the advancing bar 21, that is to say during the conveying to the next saddle region 19, it is then possible for the rest of the binding bands 5 to be removed.

It is likewise readily apparent that the reverse procedure can also be performed. In this case, the advancing bar 21 can thus correspond to the first rest 10, with the result that the first part of the binding bands 5 is thus removed while the coil 4 is resting on the advancing bar 21. In this case, the subsequent saddle region 19 furthermore corresponds to the second rest 15. In this case, the rest of the binding bands 5 are thus removed while the coil 4 is resting on this saddle region 19.

In both cases, it may be sufficient for the removal device 12 to be operable only in the region of the corresponding saddle region 19. This is because it is in particular possible for the coil 4 to be only slightly lifted off from the corresponding saddle region 19 by means of the advancing bar 21, or the advancing bar 21 to stop just before placing the coil 4 down onto the corresponding saddle region 19, and for the corresponding binding bands 5 to be removed in this state. However, it goes without saying that is also possible for the removal device 12 to be configured in such a way that it is operable beyond the region of the corresponding saddle region 19, for example up to the subsequent saddle region 19 or from the preceding saddle region 19.

It is conceivable for those binding bands 5 which are removed while the coil 4 is resting on the advancing bar 21 to be removed during the movement of the advancing bar 21. In this case, the removal device 12 has to follow the movement of the advancing bar 21. However, the movement of the advancing bar 21 is preferably interrupted so that the advancing bar 21 is not moved during the period when the coil 4 is resting on the advancing bar 21 and some of the binding bands 5 are being removed. This procedure has the advantage that the control of the removal device 12 does not have to be coordinated with the ongoing movement of the advancing bar 21.

Insofar as the orientation in the xy plane is concerned, the eye axis 9 may be oriented parallel to the conveying direction x. However, the eye axis 9 is generally oriented orthogonally with respect to the conveying direction x.

Figure 19:
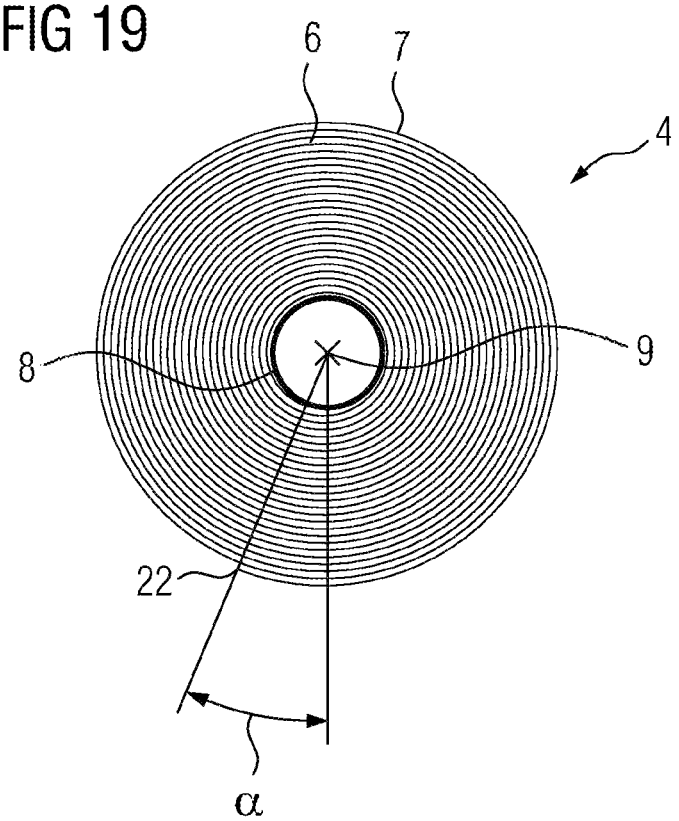
FIG. 19 shows a side view of a coil.

In accordance with the illustration in FIGS. 2 and 3, the metal strip 1 which is coiled to form the coil 4 has a strip head 22, that is to say the piece of the metal strip 1 that is coiled last. Preferably, a rotating device 23 is arranged upstream of the removal device 12. For example, in accordance with the illustration in FIG. 17, the rotating device 23 may be a constituent part of the saddle region 19 which is arranged directly upstream of the saddle region 19 at which some of the binding bands 5 are removed. Alternatively, at least one other saddle region 19 may be arranged between the saddle region 19 which comprises the rotating device 23 as a constituent part and the saddle region 19 at which some of the binding bands 5 are removed. The coil 4 is rotated about its eye axis 9 by means of the rotating device 23 so that the strip head 22 has a predetermined orientation with respect to a vertical plane, which for its part contains the (horizontally oriented) eye axis 9. For example, the coil 4 may be rotated in such a way that, in accordance with the illustration in FIG. 19, the strip head 22 is arranged below a horizontal plane containing the eye axis 9 and encloses an angle $\alpha$ of between 30° and 45° with the aforementioned vertical plane, and the outermost turn of the coil 4 first reaches its lowest point and only then its highest point as calculated from the strip head 22.

The present invention has many advantages. The most important advantage is that the binding bands 5 can be reliably removed in an automated manner independently of their position on the coil 4. A further advantage is that, in the case of a conveying operation of the coils 4, depending on the design of the associated conveying device, the eye axes 9 of the coils 4 can be oriented parallel to the conveying direction x (see the embodiments with respect to FIGS. 9 and 10) or can be oriented orthogonally with respect to the conveying direction x (see the embodiments with respect to FIGS. 16 to 18), as required.

Although the invention has been illustrated and described in more detail by the preferred exemplary embodiment, the invention is not limited by the examples disclosed, and other variants can be derived therefrom by a person skilled in the art without departing from the scope of protection of the invention.

LIST OF REFERENCE DESIGNATIONS

1 Metal strip
2 Roll stand
3 Coiler installation
4 Coils
5 Binding bands
6 End faces
7 Lateral surface
8 Coil eye
9 Eye axis
10 First rest
11 Supports
12 Removal device
12' Measuring device
13 Control device
14 Optical detection device
15 Second rest
16 Coil central axis
17 Input station
18 Further-processing station
19 Saddle regions
20 Rest regions
21 Advancing bar
22 Strip head
23 Rotating device
a Support spacing
a' Spacing
B Coil width
b Binding band width
b' Support width
D Coil diameter
P1 to P4 Arrows
x Conveying direction
y Transverse direction
$\alpha$ Angle

The invention claimed is:

1. A method for removing binding bands from a coil which is produced by coiling of a strip, wherein the coil has two end faces and a lateral surface, and also a coil eye having an eye axis, and the binding bands have a binding band width, comprising:

a) initially removing, while a first subregion of the lateral surface of the coil, in a direction of the eye axis, is resting on a first rest, first binding bands which, in the direction of the eye axis, surround the coil completely outside the first subregion; and b) further removing, while a second subregion of the coil, in the direction of the eye axis, is resting on the first rest or a second rest, the first and the second subregion, in the direction of the eye axis, being spaced apart from one another at least by a binding band width, second binding bands which were not removed in step a);

wherein the coil is conveyed, by an advancing bar, in several stages in a substantially horizontal conveying direction from a first stationary saddle region to a second stationary saddle region, such that the coil alternately rests on one of the saddle regions and the advancing bar;

wherein the coil is conveyed between step a) and step b) in the conveying direction, the conveying direction being orthogonal to the eye axis; and wherein:

either a predetermined one of the saddle regions corresponds to the first rest, the advancing bar corresponds to the second rest, step a) is carried out while the coil is resting on the predetermined saddle region, and step b) is carried out while the coil is being conveyed from the predetermined saddle region to the subsequent saddle region by the advancing bar;

or, conversely, the advancing bar corresponds to the first rest, a predetermined one of the saddle regions corresponds to the second rest, step a) is carried out while the coil is being conveyed from the preceding saddle region to the predetermined saddle region by the advancing bar, and step b) is carried out while the coil is resting on the predetermined saddle region.

2. The removal method as claimed in claim 1, wherein, in the direction of the eye axis, the first subregion contains the edge regions of the lateral surface of the coil which adjoin the two end faces, and the second subregion contains a central region of the coil, said central region being spaced apart from both end faces, or, conversely, the first subregion contains the central region of the coil, and the second subregion contains the two edge regions of the coil.

3. The removal method as claimed in claim 1, wherein the eye axis is oriented substantially orthogonally with respect to the conveying direction.

4. The removal method as claimed in claim 1, wherein, prior to carrying out step a), the coil is rotated about its eye axis so that a strip head of the strip has a predetermined orientation with respect to a vertical plane containing the eye axis.

5. The removal method as claimed in claim 1, wherein a diameter of the coil is determined by measurement while at least one of:

the first subregion of the coil is resting on the first rest in step a); and the second subregion of the coil is resting on the first or the second rest in step b).

6. The removal method as claimed in claim 1, wherein the coil rests on one of the first rest and the second rest alternately.

7. A removal installation for removing binding bands from a coil which is produced by coiling of a strip, wherein the coil has two end faces and a lateral surface, and also a coil eye having an eye axis, comprising:

a first rest; and a second rest;

wherein, in a direction of the eye axis, a first subregion of the lateral surface of the coil can rest on the first rest at a first point in time;

wherein either the first rest or the second rest is designed in such a way that, in the direction of the eye axis, a second subregion of the lateral surface of the coil can rest on the first rest or on the second rest at a second point in time following the first point in time;

wherein the first and the second subregion, in the direction of the eye axis, are spaced apart from one another;

wherein the removal installation further comprises a removal device, by which the binding bands which, in the direction of the eye axis, surround the coil completely outside the first subregion can be removed while the first subregion of the lateral surface of the coil is resting on the first rest, and by which the rest of the binding bands which surround the coil can be removed while the second subregion of the lateral surface of the coil is resting on the first or the second rest;

wherein the removal installation further comprises a first stationary saddle region and a second stationary saddle region;

wherein the removal installation comprises an advancing bar, by which the coil can be conveyed in several stages in a substantially horizontal conveying direction from the first stationary saddle region to the second stationary saddle region, the conveying direction being orthogonal to the eye axis, such that the coil alternately rests on one of the saddle regions and the advancing bar during the conveying operation;

wherein, in that either a predetermined one of the saddle regions corresponds to the first rest and the advancing bar corresponds to the second rest or the advancing bar corresponds to the first rest and the predetermined saddle region corresponds to the second rest; and wherein, in that the removal device can be operated at least in the region of the predetermined saddle region.

8. The removal installation as claimed in claim 7, wherein the first rest is designed in such a way, or the first and the second rest are designed in such a way, that, in the direction of the eye axis, the first subregion contains the edge regions of the lateral surface of the coil which adjoin the two end faces, and the second subregion contains a central region of the coil, said central region being spaced apart from both end faces, or, conversely, the first subregion contains the central region of the coil, and the second subregion contains the two edge regions of the coil.

9. The removal installation as claimed in claim 8, wherein the eye axis is oriented substantially orthogonally with respect to the conveying direction.

10. The removal installation as claimed in claim 7, wherein it comprises a rotating device which is arranged upstream of the removal device and by which the coil can be rotated about its eye axis so that a strip head of the strip has a predetermined orientation with respect to a vertical plane containing the eye axis.

11. The removal installation as claimed in claim 7, wherein the removal device is assigned a measuring device, by which a diameter of the coil can be determined while at least one of the first subregion of the coil is resting on the first rest and the second subregion of the coil is resting on the first or the second rest.

12. The removal installation as claimed in claim 7, wherein the removal device is designed as a robot.

13. The removal installation as claimed in claim 7, wherein the removal device comprises an optical detection device for detecting the binding bands which surround the coil.

14. The removal installation as claimed in claim 7, wherein the coil rests on one of the first rest and the second rest alternately.

15. A method for removing binding bands from a coil produced by coiling of a strip, the coil having two end faces, a lateral surface, and a coil eye having an eye axis, the binding bands have a binding band width and being oriented around the eye axis, comprising:

first removing, while a first subregion of the lateral surface of the coil, in a direction of the eye axis, is resting on a first rest, first binding bands which, in the direction of the eye axis, surround the coil completely outside the first subregion;

conveying the coil by an advancing bar, in a conveying direction orthogonal to the eye axis, from a first stationary saddle region to a second stationary saddle region; and second removing, while a second subregion of the coil, in the direction of the eye axis, is resting on a second rest, second binding bands which, in the direction of the eye axis, surround the coil completely outside the second subregion, the second binding bands being spaced apart from the first binding bands at least by a binding band width.

16. The method as claimed in claim 15, wherein the first rest comprises the first stationary saddle region and the second rest comprises one of the advancing bar and the second stationary saddle region.

17. The method as claimed in claim 15, wherein the first rest comprises the advancing bar and the second rest comprises the second stationary saddle region.

18. The method as claimed in claim 15, wherein the coil rests on one of the first rest and the second rest alternately.

* * * * *